US008531256B2

(12) United States Patent
Maloney

(10) Patent No.: US 8,531,256 B2
(45) Date of Patent: Sep. 10, 2013

(54) TOOL AND CALIBRATION MACHINE FOR CALIBRATING A THERMAL TRIP APPARATUS OF A CIRCUIT INTERRUPTER, AND IMPROVED METHOD

(75) Inventor: James Gerard Maloney, Industry, PA (US)

(73) Assignee: Eaton Corporation, Cleveland, OH (US)

( * ) Notice: Subject to any disclaimer, the term of this patent is extended or adjusted under 35 U.S.C. 154(b) by 244 days.

(21) Appl. No.: 13/246,151

(22) Filed: Sep. 27, 2011

(65) Prior Publication Data

US 2013/0076479 A1 Mar. 28, 2013

(51) Int. Cl.

| | |
|---|---|
| ***H01H 75/08*** | (2006.01) |
| ***H01H 77/04*** | (2006.01) |
| ***H01H 81/02*** | (2006.01) |

(52) U.S. Cl.

USPC ..... 335/45

(58) Field of Classification Search

USPC ..... 335/42, 45

See application file for complete search history.

(56) References Cited

U.S. PATENT DOCUMENTS

| | | | | |
|---|---|---|---|---|
| 2,659,783 | A * | 11/1953 | Casey | 335/23 |
| 3,464,040 | A * | 8/1969 | Powell | 335/191 |
| 4,520,244 | A | 5/1985 | Forsell et al. | |
| 4,891,621 | A | 1/1990 | Heckenkamp et al. | |
| 5,317,471 | A * | 5/1994 | Izoard et al. | 361/105 |
| 5,608,367 | A | 3/1997 | Zoller et al. | |
| 5,793,026 | A | 8/1998 | Kolberg et al. | |
| 5,831,501 | A | 11/1998 | Kolberg et al. | |
| 5,894,259 | A | 4/1999 | Kolberg et al. | |
| 6,218,917 | B1 * | 4/2001 | Criniti et al. | 335/35 |
| 6,225,883 | B1 | 5/2001 | Wellner et al. | |
| 6,239,676 | B1 | 5/2001 | Maloney et al. | |
| 6,307,453 | B1 | 10/2001 | Wellner et al. | |
| 6,486,759 | B2 * | 11/2002 | Haugh et al. | 335/38 |
| 6,522,228 | B2 | 2/2003 | Wellner et al. | |
| 6,542,056 | B2 | 4/2003 | Nerstrom et al. | |
| 6,650,515 | B2 | 11/2003 | Schmalz | |
| 6,710,688 | B2 | 3/2004 | Wellner et al. | |
| 6,788,174 | B1 | 9/2004 | Afshari et al. | |
| 6,813,131 | B2 | 11/2004 | Schmalz | |
| 6,864,765 | B2 | 3/2005 | Wellner et al. | |
| 7,859,369 | B2 | 12/2010 | Lias et al. | |

* cited by examiner

*Primary Examiner* — Alexander Talpalatski

(74) *Attorney, Agent, or Firm* — Eckert Seamans Cherin & Mellott, LLC; Brij K. Agarwal

(57) ABSTRACT

An improved calibration machine for calibrating a thermal trip apparatus of a circuit interrupter employs a tool having an elongated shank and a pair of engagement elements. The engagement elements are engageable with a support that carried a bimetal element. The engagement elements can deform the support in opposite directions to either increase or decrease the thermal trip setting of the thermal trip apparatus. If the support is over-deformed in one direction, it can be deformed in an opposite direction to enable a circuit interrupter whose thermal trip apparatus has been deformed beyond a desired target thermal calibration setting to be deformed in an opposite direction to reach the desired target thermal calibration setting.

16 Claims, 5 Drawing Sheets

TOOL AND CALIBRATION MACHINE FOR CALIBRATING A THERMAL TRIP APPARATUS OF A CIRCUIT INTERRUPTER, AND IMPROVED METHOD

BACKGROUND

1. Field

The disclosed and claimed concept relates generally to circuit interrupters and, more particularly, to an improved tool and calibration machine employed in calibrating a thermal trip apparatus of a circuit interrupter.

2. Related Art

Numerous types of circuit interrupters are known for use in diverse applications. One type of a circuit interrupter is a circuit breaker having an operating mechanism that moves the circuit breaker between an ON condition, an OFF condition, and a TRIPPED condition. Such circuit breakers typically also include a trip mechanism that causes the operating mechanism to move the circuit breaker from the ON condition to the TRIPPED condition. The trip mechanism can include any one or more of a variety of components that can trigger the operating mechanism to open a set of separable contacts in any of a variety of overcurrent and under-voltage conditions. One type of known component of a trip mechanism is a thermal trip apparatus which includes a bimetal element that becomes heated in a persistent overcurrent condition and accordingly trips the circuit breaker.

While such thermal trip apparatuses have been generally effective for their intended purposes, they have not been without limitation. As is generally understood in the relevant art, a bimetal element deflects in a predetermined fashion upon heating. However, due to manufacturing variations and tolerances, the thermal trip apparatus of any given circuit breaker must be calibrated during the manufacturing process. That is, each circuit breaker's thermal trip apparatus is adjusted so that it causes the circuit breaker to trip in response to a predetermined persistent overcurrent condition, by way of example. In certain circuit breakers, the calibration process has involved an inelastic (i.e., plastic) deformation of a frame within the circuit breaker upon which the bimetal element is carried. Such an inelastic deformation occurs by receiving a rectangular-shaped object into an interior region of the circuit breaker and rotating the rectangular-shaped object to engage and inelastically deform the frame until the bimetal element has moved sufficiently that it is calibrated to trigger the operating mechanism at a predetermined current level.

However, if the frame has been deformed beyond the calibration point, the deformation of the frame cannot be reversed without substantial reworking of the circuit breaker, with the result that an unacceptably high number of rejected circuit breakers must be discarded because they were over-deformed during the calibration operating and cannot be easily calibrated thereafter. It thus would be desirable to provide an improved system for calibrating a thermal trip apparatus of a circuit interrupter.

SUMMARY

An improved calibration machine for calibrating a thermal trip apparatus of a circuit interrupter employs a tool having an elongated shank and a pair of engagement elements. The engagement elements are engageable with a support that carried a bimetal element. The engagement elements can deform the support in opposite directions to either increase or decrease the thermal trip setting of the thermal trip apparatus. If the support is over-deformed in one direction, it can be deformed in an opposite direction to enable a circuit interrupter whose thermal trip apparatus has been deformed beyond a target thermal calibration setting to be deformed in an opposite direction to reach the target thermal calibration setting.

Accordingly, an aspect of the disclosed and claimed concept is to provide an improved calibration machine that employs an improved tool to perform a calibration operation on a thermal trip apparatus of a circuit interrupter.

Another aspect of the disclosed and claimed concept is to provide an improved method of performing such a calibration operation.

Another aspect of the disclosed and claimed concept is to provide an improved circuit breaker having components including a thermal trip apparatus that are capable of calibration through an inelastic deformation of a support in either of two directions and that permits the support to be returned to a calibration setting even after the support has been inelastically deformed beyond the calibration setting.

These and other aspects of the disclosed and claimed concept are provided by an improved method of employing a tool in calibrating a thermal trip apparatus of a circuit interrupter. The thermal trip apparatus can be generally stated as including a thermal trip element and a support upon which the thermal trip element is disposed. The tool has an elongated shank and at least a first engagement element extending from the shank in a direction generally perpendicular to the direction of elongation of the shank. The method can be generally stated as including detecting a thermal calibration setting of the thermal trip apparatus, engaging the thermal trip apparatus with the tool, deforming the support by applying one of a compressive force and a tensile force to the shank when the thermal calibration setting is higher than a target thermal calibration setting, and deforming the support by applying the other of a compressive force and a tensile force to the shank when the thermal calibration setting is lower than the target thermal calibration setting.

Other aspects of the disclosed and claimed concept are provided by an improved calibration machine that is structured to calibrate a thermal trip apparatus of a circuit interrupter. The thermal trip apparatus can be generally stated as including a thermal trip element and a support upon which the thermal trip element is disposed. The calibration machine can be generally stated as including a processor apparatus, an input apparatus connected, and an output apparatus. The processor apparatus can be generally stated as including a processor and a memory. The input apparatus is connected with the processor apparatus and can be generally stated as including at least a first sensor structured to detect a thermal calibration setting of the thermal trip apparatus. The output apparatus is connected with the processor apparatus and can be generally stated as including an actuator and a tool, the actuator being connected with the processor apparatus and with the tool, the tool having an elongated shank and having at least a first engagement element extending from the shank in a direction generally perpendicular to the direction of elongation of the shank. The memory has stored therein a number of routines which, when executed on the processor, cause the calibration machine to perform operations that can be generally stated as including detecting a thermal calibration setting of the thermal trip apparatus, engaging the thermal trip apparatus with the tool, deforming the support by applying one of a compressive force and a tensile force to the shank when the thermal calibration setting is higher than a target thermal calibration setting, and deforming the support by applying the other of a compressive force and a tensile force to the shank when the thermal calibration setting is lower than the target thermal calibration setting.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 1:
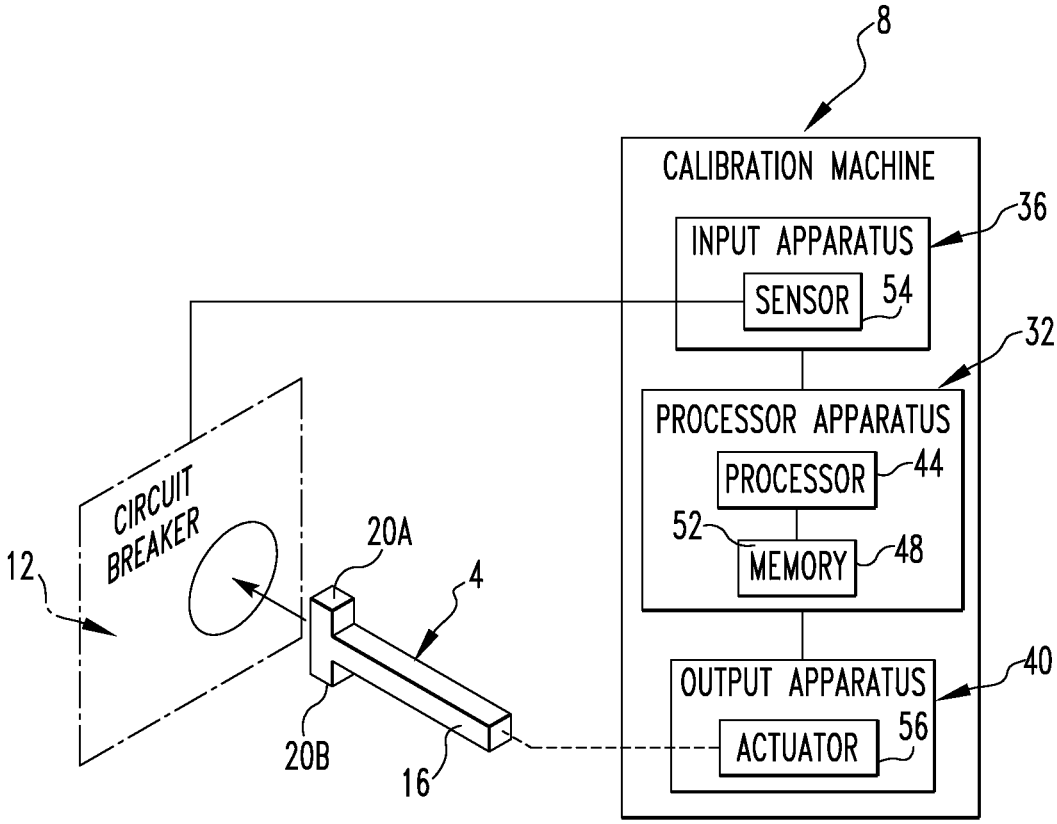
FIG. 1 is a schematic depiction of an improved calibration machine that employs an improved tool to calibrate a thermal trip apparatus of an improved circuit interrupter.

An improved tool 4 is depicted in FIG. 1 as being employed by a schematically-depicted improved calibration machine 8 in order to perform a calibration operation on a circuit interrupter 12. The tool 4 can generally be described as being of a T-shaped configuration having an elongated shank 16 and a pair of engagement elements 20A and 20B that extend outwardly from the shank 16 in directions substantially perpendicular to the direction of elongation of the shank 16. In the depicted exemplary embodiment, the engagement elements 20A and 20B extend in opposite directions away from the shank 16, but in other embodiments the engagement elements 20A and 20B can have other positional relationships without departing from the present concept. The engagement elements 20A and 20B each have a distal engagement surface 24A and 24B, respectively, facing generally away from the shank 16, and further each have a proximal engagement surface 28A and 28B, respectively, facing generally in a direction toward the shank 16.

As can further be understood from FIG. 1, the calibration machine 8 includes a processor apparatus 32, an input apparatus 36, and an output apparatus 40 that are connected together and that are configured to perform a calibration operation on the circuit interrupter 12. The processor apparatus 32 includes a processor 44 and a memory 48 in communication with one another. The processor 44 can be any of a wide variety of processors such as a microprocessor or other processor without limitation. The memory 48 can be any of a wide variety of storage media, whether or not removable, and can include one or more arrays of RAM, ROM, EPROM, EEPROM, FLASH, and the like without limitation. The memory 48 has stored therein a number of routines that are collectively referred to with the numeral 52 and which are executable on the processor 44 to cause the calibration machine 8 to perform various operations. The routines 52 expressly include a calibration routine 52 which causes the calibration machine 8 to perform a calibration operation on the circuit interrupter 12 that will be described in greater detail below.

The input apparatus 36 includes at least one sensor 54 that is configured to detect a thermal trip setting of the circuit interrupter 12. By way of example, the sensor 52 may be configured to detect the level of current flow over time in the circuit interrupter 12 and to further detect a point at which the circuit interrupter 12 experiences a thermal trip, at which point current typically ceases to flow. The sensor 54 in conjunction with one or more of the routines 52 can thus be said to detect a thermal trip setting of the circuit interrupter 12. Other input devices may be employed in the input apparatus 36 without departing from the present concept.

The output apparatus 40 of the depicted exemplary embodiment includes an actuator 56 which physically moves the tool 4 in a number of predetermined fashions. The actuator 56 is schematically depicted in FIG. 1 but is understood to include a number of devices that can apply compressive and tensile forces to the shank 16 of the tool 4 and can also apply torques to the shank 16 to rotate the tool 4 about the direction of elongation of the shank 16. The actuator 56 is controlled by the processor 44 in order to adjust the thermal trip setting of the circuit interrupter 12 in response to a detection of a current thermal trip setting of the circuit interrupter 12. That is, the processor apparatus 32 and the input apparatus 36 are cooperable to detect a present thermal trip setting of the circuit interrupter, and the processor apparatus 32 is further configured to determine the extent of departure of the present thermal trip setting from a desired target thermal calibration setting. The processor apparatus 32 thus sends instructions to the actuator 56 to manipulate the tool 4 in a fashion that will be set forth in greater detail below to adjust the thermal trip setting of the circuit interrupter 12 until it reaches the desired target thermal calibration setting.

Figure 2:
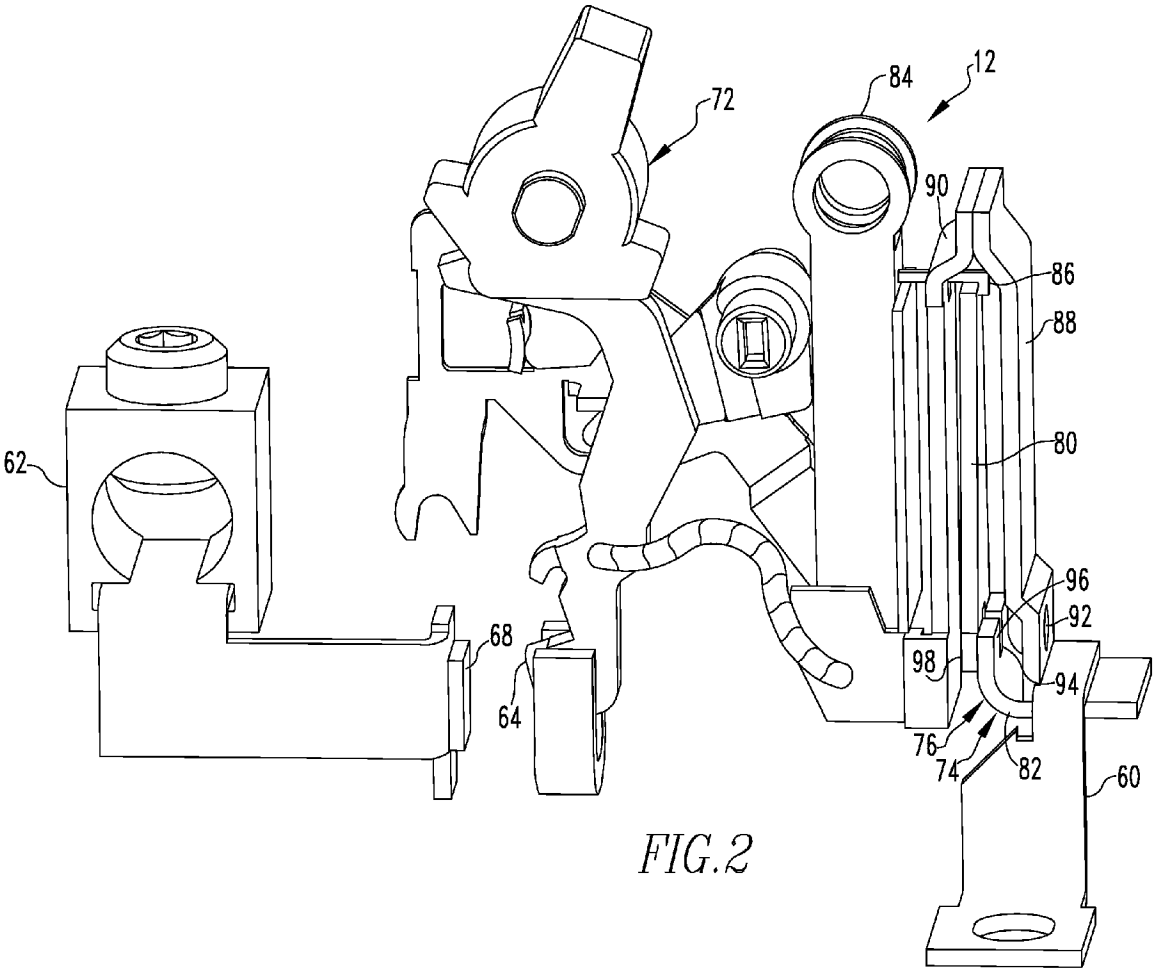
FIG. 2 shows the improved circuit breaker that is depicted schematically in FIG. 1.

As can be understood from FIG. 2, the circuit interrupter 12 includes a line terminal 60 and a load terminal 62 through which current passes when the circuit interrupter 12 is in an ON condition. The circuit interrupter 12 typically also includes a case or other type of enclosure, although this is not illustrated herein for purposes of simplicity of disclosure. It is noted, however, that the circuit interrupter 12 is depicted as having an aperture formed in the case that enables access by the tool 4 to the interior of the circuit interrupter 12.

The circuit interrupter 12 further includes a pair of separable contacts that include a movable contact 64 connected with the line terminal 60 and a stationary contact 68 connected with the load terminal 62. The circuit interrupter 12 is depicted in FIG. 2 as being in an OFF condition with the movable and stationary contacts 64 and 68 separated from one another. The circuit interrupter 12 additionally includes an operating mechanism 72 that is operable to move the circuit interrupter 12 among the ON condition, the OFF condition, and a TRIPPED condition. The circuit interrupter 12 further includes a trip mechanism 74 that includes a variety of systems that can trigger the operating mechanism 72 to move the circuit interrupter 12 from the ON condition to the TRIPPED condition.

In particular, the trip mechanism 74 advantageously includes an improved thermal trip apparatus 76 that is depicted at least in part in FIGS. 2-6 and which includes a bimetal element 80 that is mounted on a support 82. As is understood in the relevant art, the bimetal element 80 is configured to deflect in a predetermined fashion in response to an increase in its temperature. The support 82 typically is stationary during operation of the circuit interrupter 12. The end of the bimetal element 80 that is opposite the support 82 is connected to a latch mechanism 84 of the operating mechanism 72 through the use of a leg 86 that extends from the latch mechanism 84 and which captures the end of the bimetal element 80. When the bimetal element 80 deflects in its predetermined fashion in response to heating, the deflection of the end of the bimetal element 80 pulls the leg 86 to the right from the perspective of FIG. 2. This pivots the latch mechanism 84 which causes the operating mechanism 72 to move the circuit interrupter 12 from its ON condition to its TRIPPED condition.

As can further be understood from FIG. 2, the circuit interrupter 12 additionally includes a first conductor 88 and a second conductor 90 that are disposed at opposite sides of the bimetal element 80 and through which the current passes when the circuit interrupter 12 is in its ON condition. The first and second conductors 88 and 90 generate $I^2R$ heat in response to current flow through the circuit interrupter 12, with such heat in turn heating the bimetal element 80 via radiation and convection mechanisms. In the event of a persistent high current, if the bimetal element 80 heats sufficiently, it will deflect in a clockwise direction from the perspective of FIG. 2 and pull the leg 86 with it to release the latch mechanism 84 and move the circuit interrupter 12 from its ON condition to its TRIPPED condition.

As can be understood from FIGS. 2-6, the first conductor 88 has an opening 92 formed therein that is shaped to receive at least a portion of the tool 4, particularly the engagement elements 20A and 20B, therethrough. While in the embodiment depicted herein the opening 92 is of a round shape to enable the tool 4 to be received therein in any orientation, the opening 92 in other embodiments could be of a rectangular shape or other shape as may be necessary depending upon the desired ability to accommodate the tool 4 therethrough and the acceptability of the effect on the conductive properties of the first conductor 88.

As can further be seen from FIGS. 2-6, the thermal trip apparatus 76 has a hole 94 formed therein that is of a rectangular shape and that is sized to likewise receive a portion of the tool 4 therethrough, particularly the engagement elements 20A and 20B. In the depicted exemplary embodiment, the hole 94 can be said to be formed in both the bimetal element 80 and the support 82, but the hole 94 could be otherwise configured without departing from the present concept. The thermal trip apparatus 76 can also be said to have a first surface 96 that faces generally toward the opening 92 and an opposite second surface 98 that can be said to extend generally away from the opening 92.

Figure 3:
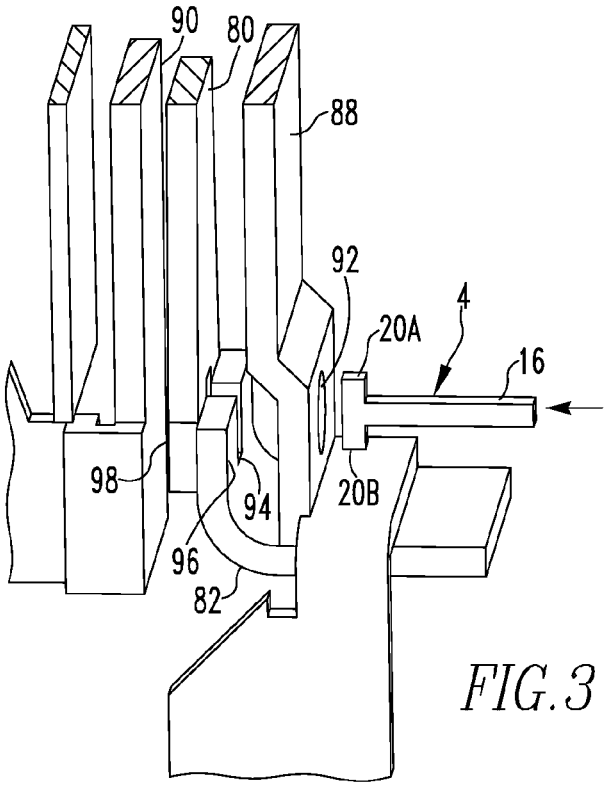
FIG. 3 is a depiction of the improved tool of FIG. 1 in proximity to an enlarged portion of the circuit breaker of FIG. 2 during an initial portion of an improved calibration operation.
Figure 4:
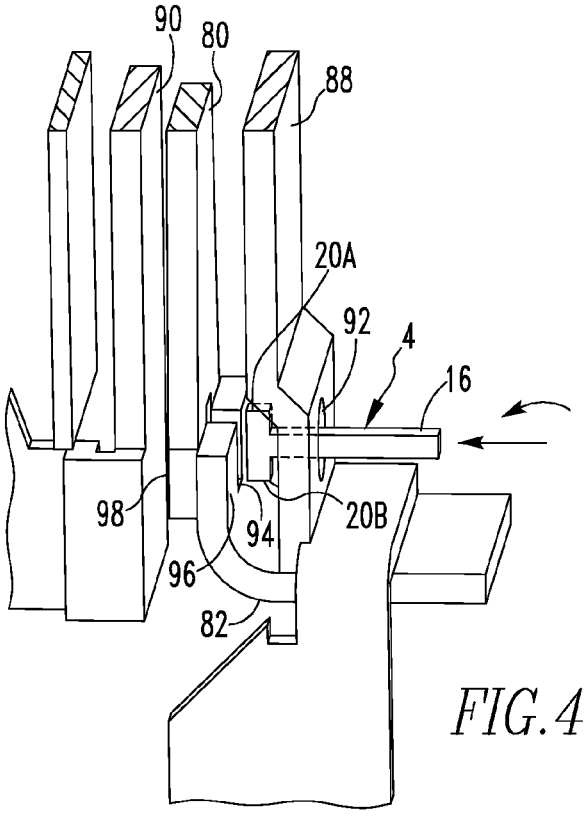
FIG. 4 is a view similar to FIG. 3, except depicting a different stage of the calibration operation.

The calibration operation can be stated to generally begin with the tool 4 being situated at the exterior of the circuit interrupter 12, as is indicated generally in FIG. 3. While the tool 4 is depicted in FIGS. 3-6 as being unconnected with the calibration machine 8, it is understood that the calibration machine 8 will actually be connected with the tool 4, but the calibration machine 8 is not expressly depicted in FIGS. 3-6 for reasons on simplicity of disclosure.

The portion of the tool 4 that includes the engagement elements 20A and 20B is translated by the actuator 56 to be received through the opening 92 until the engagement elements 20A and 20B are situated generally between the first conductor 88 and the support 82. In such position, the tool 4 can be rotated by the actuator 56 about the direction of elongation of the shank 16, if needed. That is, depending upon the orientation in which the tool 4 was received through the opening 92, such as with the engagement elements 20A and 20B being disposed above and below one another as is indicated generally in FIG. 4, a rotation of the tool about the direction of elongation of the shank 16 through an angle of about ninety degrees will orient the engagement elements 20A and 20B in a horizontal arrangement from the perspective of FIGS. 3-6.

Figure 5:
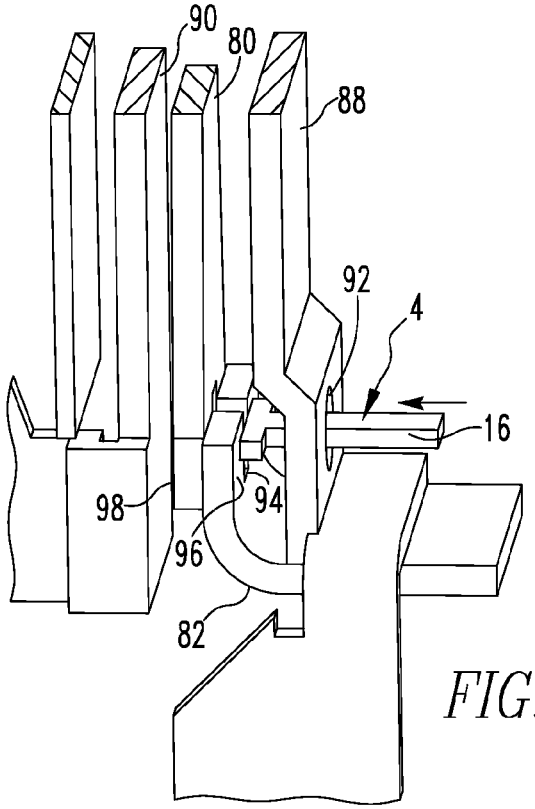
FIG. 5 is a view as similar to FIGS. 3 and 4, except depicting the tool engaged with a support of a thermal trip apparatus of the circuit breaker pursuant to a deformation force being applied to the support to increase the calibration setting of the thermal trip apparatus.
Figure 6:
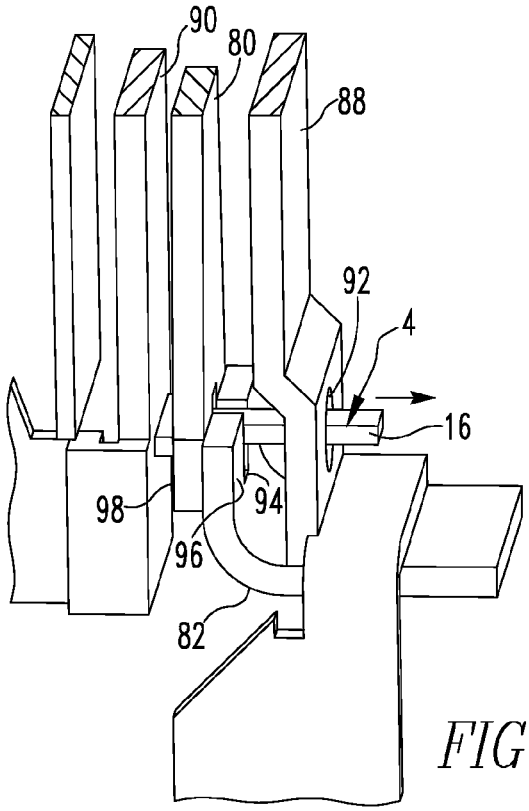
FIG. 6 is view similar to FIG. 5, except depicting an opposite deformation force being applied to the support to decrease the calibration setting of the thermal trip apparatus.

In such an orientation, a compressive force can be applied by the actuator 56 to the shank 16 to cause the engagement elements 20A and 20B to engage the first surface 96, as is indicated generally in FIG. 5. Further compressive force applied by the actuator 56 to the shank 16 and transferred to the support 82 causes the support 82 to be inelastically deformed. That is, the deformation of the support 82 can be beyond the limits of elasticity of the support 82 to cause a plastic deformation of the support 82. Such a deformation of the support 82 to the left as is indicated generally in FIG. 5 will raise, i.e., increase, the thermal trip setting of the thermal trip apparatus 76 since it will increase the deflection that is required of the bimetal element 80 to move the leg 86 and thus operate the latch mechanism 84. As has been suggested elsewhere herein, the calibration operation actually would have begun with an initial test on the circuit interrupter 12 to ascertain a preliminary thermal trip setting of the thermal trip apparatus 76, and if the calibration routine 52 determines that the preliminary thermal trip setting is too low, the calibration routine 52 may instruct the actuator 56 to apply a compressive force to the shank 16 to deform the support 82 in the fashion depicted generally in FIG. 5 to increase the thermal trip setting.

On the other hand, if the calibration routine 52 determines that the thermal trip setting of the thermal trip apparatus 76 is too high, the actuator 56 can pivot the tool 4 about the direction of elongation of the shank 16, as needed, to align the engagement elements 20A and 20B with the hole 94 formed in the thermal trip apparatus 76. The shank 16 can then be translated by the actuator 56 to receive that portion of the tool 4 through the hole 94. The tool 4 can thereafter be pivoted by the actuator 56 about the direction of elongation of the shank 16 through an angle of about ninety degrees and can thereafter apply a tensile force to the shank 16 to cause the engagement elements 20A and 20B to engage the second surface 98, as is indicated generally in FIG. 6. Further application of such a tensile force to the shank 16 causes inelastic deformation of the support 82 in a direction generally to the right in FIG. 6, which has the effect of lowering, i.e., decreasing, the thermal trip setting of the thermal trip apparatus 76 by moving the end of the bimetal element 80 opposite the support 82 closer to the free end of the leg 86 or into engagement with the free end of the leg 86.

While the deformations of the support 82 through engagement of the tool 4 with the support 82 (by operation of the actuator 56) causes inelastic, i.e., plastic, deformation of the support 82 which changes the thermal trip setting of the thermal trip apparatus 76, it can be understood that such deformation can be reversed by applying a deformation force to the support 82 in an opposite direction. That is, if the support 82 is deformed as is indicated generally in FIG. 5 in a fashion that increases the thermal trip setting higher than the target thermal calibration setting, the tool 4 can be moved by the actuator 56 to engage the second surface 98, as is indicated generally in FIG. 6, to apply a deformation force in the opposite direction to reduce the thermal trip setting of the thermal trip apparatus 76. In this regard, it is understood that the calibration routine 52 not only generates the initial signals to adjust the thermal trip setting by inelastically deforming the support 82, the calibration routine 52 additionally instructs the sensor 54 to subsequently assess the adjusted thermal trip setting of the thermal trip apparatus 76 to ensure that it is within a desired range of the target thermal calibration setting. If it is not, the calibration routine 52 will instruct the actuator 56 to move the tool 4 to make further deformation engagements with the first and/or second surfaces 96 and 98 of the support 82 until the adjusted thermal trip setting of the circuit interrupter 12 is determined to be within the desired range of the target thermal calibration setting.

It thus can be seen that the advantageous configuration of the thermal trip apparatus 76 and the circuit interrupter 12 enable the calibration machine 8 and the tool 4 to adjust and readjust the thermal trip setting of the circuit interrupter 12 without the need to heavily rework the circuit interrupter 12 and without the need to discard circuit interrupters that have been deformed past the target thermal calibration setting. Advantageously, therefore, the circuit interrupter 12 is relatively less expensive to manufacture than previously known circuit breakers due to the avoidance of waste in the manufacturing process. Other advantages will be apparent to those of ordinary skill in the art.

Figure 7:
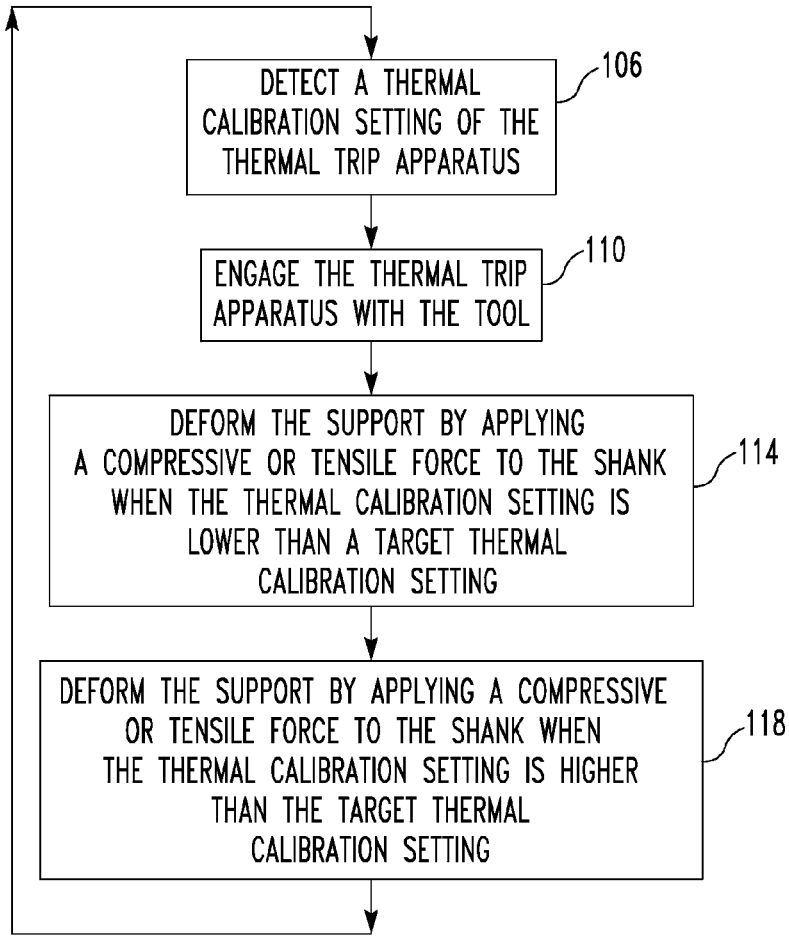
FIG. 7 is a flowchart depicting certain aspects of an improved method in accordance with the disclosed and claimed concept.

An improved method in accordance with another aspect of the disclosed and claimed concept is depicted with a flowchart in FIG. 7. A method of employing the calibration machine 8 and the tool 4 can be said to begin, as at 106, with the detecting of a thermal calibration setting of the thermal trip apparatus 76 of the circuit interrupter 12. As a part of this operation, the calibration routine 52 will make a determination of the extent to which the thermal calibration setting needs to be increased or decreased in order to reach the target thermal calibration setting, and it will also therefore make a determination whether the distal engagement surfaces 24A and 24B or the proximal engagement surfaces 28A and 28B will be used to inelastically deform the support 82.

Processing then continues, as at 110, where the tool 4 is engaged with the thermal trip apparatus 76. Processing can then be said to continue, as at 114, with the deforming of the support 82 by applying a compressive force to the shank 16 when the thermal calibration setting is one of higher and lower than the target thermal calibration setting, and, as at 118, deforming the support 82 by applying a tensile force to the shank 16 when the thermal calibration setting is the other of higher and lower than the thermal calibration setting. In the exemplary embodiment set forth herein, the compressive force is applied to the shank 16 when the thermal trip setting is lower than the target thermal calibration setting, and the distal engagement surfaces 24A and 24B are engaged with the support 82. Similarly, the tensile force is applied to the shank 16 when the thermal calibration setting is higher than the target thermal calibration setting and the proximal engagement surfaces 28A and 28B are engaged with the second surface 98 of the thermal trip apparatus 76. It is reiterated that if the deformation of the support 82 causes the thermal trip apparatus to be over-calibrated, i.e., too high or too low in comparison with the target thermal calibration setting, the support 82 can simply be deformed in the opposite direction to reverse the over-calibration of the thermal trip apparatus 76, which avoids having to reject and discard circuit interrupters as was done using previously known methodologies.

The improved calibration machine 8 with its improved tool 4 thus can be used to calibrate the thermal trip apparatus 76 of the circuit interrupter 12. Such calibration can be done efficiently and rapidly and without the need to discard circuit breakers that have been over-calibrated and cannot be brought back into calibration. Other advantages will be apparent to those of ordinary skill in the art.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A method of employing a tool in calibrating a thermal trip apparatus of a circuit interrupter, the thermal trip apparatus comprising a thermal trip element and a support upon which the thermal trip element is disposed, the tool having an elongated shank and having at least a first engagement element extending from the shank in a direction generally perpendicular to the direction of elongation of the shank, the method comprising:

detecting a thermal calibration setting of the thermal trip apparatus;

engaging the thermal trip apparatus with the tool;

deforming the support by applying one of a compressive force and a tensile force to the shank when the thermal calibration setting is higher than a target thermal calibration setting; and deforming the support by applying the other of a compressive force and a tensile force to the shank when the thermal calibration setting is lower than the target thermal calibration setting.

2. The method of claim 1, further comprising receiving at least a portion of the tool through an opening formed in a conductor disposed adjacent the support prior to the engaging.

3. The method of claim 2, further comprising rotating the tool through approximately ninety degrees about the direction of elongation of the shank prior to the engaging.

4. The method of claim 3, further comprising applying with a compressive force to the shank a deformation force to a surface of the thermal trip apparatus that faces generally toward the opening formed in the conductor.

5. The method of claim 3, further comprising additionally receiving at least a portion of the tool through a hole formed in the support prior to the rotating of the tool, and further comprising applying with a tensile force to the shank a deformation force to a surface of the thermal trip apparatus that faces generally away from the opening formed in the conductor.

6. The method of claim 1, further comprising, subsequent to the deforming:

detecting another thermal calibration setting of the thermal trip apparatus;

determining that the another thermal calibration setting is one of higher and lower than the target thermal calibration setting;

engaging the thermal trip apparatus with the tool; and performing another deformation of the support by applying one of a compressive force and a tensile force to the shank.

7. The method of claim 1 wherein the deforming of the support comprises applying one of a compressive force and a tensile force to the shank, and further comprising subsequent to the deforming:

detecting another thermal calibration setting of the thermal trip apparatus;

determining that the another thermal calibration setting is one of higher and lower than the target thermal calibration setting;

engaging the thermal trip apparatus with the tool; and performing another deformation of the support by applying the other of a compressive force and a tensile force to the shank.

8. A circuit interrupter having a thermal trip apparatus calibrated according to the method of claim 1.

9. A calibration machine structured to calibrate a thermal trip apparatus of a circuit interrupter, the thermal trip apparatus comprising a thermal trip element and a support upon which the thermal trip element is disposed, the calibration machine comprising:

a processor apparatus comprising a processor and a memory;

an input apparatus connected with the processor apparatus and comprising at least a first sensor structured to detect a thermal calibration setting of the thermal trip apparatus;

an output apparatus connected with the processor apparatus and comprising an actuator and a tool, the actuator being connected with the processor apparatus and with the tool, the tool having an elongated shank and having at least a first engagement element extending from the shank in a direction generally perpendicular to the direction of elongation of the shank;

the memory having stored therein a number of routines which, when executed on the processor, cause the calibration machine to perform operations comprising:

detecting a thermal calibration setting of the thermal trip apparatus;

engaging the thermal trip apparatus with the tool;

deforming the support by applying one of a compressive force and a tensile force to the shank when the thermal calibration setting is higher than a target thermal calibration setting; and deforming the support by applying the other of a compressive force and a tensile force to the shank when the thermal calibration setting is lower than the target thermal calibration setting.

10. The calibration machine of claim 9 wherein the operations further comprise receiving at least a portion of the tool through an opening formed in a conductor disposed adjacent the support prior to the engaging.

11. The calibration machine of claim 10 wherein the operations further comprise rotating the tool with the actuator through approximately ninety degrees about the direction of elongation of the shank prior to the engaging.

12. The calibration machine of claim 11 wherein the operations further comprise employing the actuator to apply with a compressive force to the shank a deformation force to a surface of the thermal trip apparatus that faces generally toward the opening formed in the conductor.

13. The calibration machine of claim 11 wherein the operations further comprise additionally receiving at least a portion of the tool through a hole formed in the support prior to the rotating of the tool, and employing the actuator to apply with a tensile force to the shank a deformation force to a surface of the thermal trip apparatus that faces generally away from the opening formed in the conductor.

14. The calibration machine of claim 9 wherein the operations further comprise, subsequent to the deforming:

detecting another thermal calibration setting of the thermal trip apparatus;

determining that the another thermal calibration setting is one of higher and lower than the target thermal calibration setting;

engaging the thermal trip apparatus with the tool; and performing with the actuator another deformation of the support by applying one of a compressive force and a tensile force to the shank.

15. The calibration machine of claim 9 wherein the deforming of the support comprises applying one of a compressive force and a tensile force to the shank, and wherein the operations further comprise, subsequent to the deforming:

detecting another thermal calibration setting of the thermal trip apparatus;

determining that the another thermal calibration setting is one of higher and lower than the target thermal calibration setting;

engaging the thermal trip apparatus with the tool; and performing with the actuator another deformation of the support by applying the other of a compressive force and a tensile force to the shank.

16. A circuit interrupter having a thermal trip apparatus calibrated by the calibration machine of claim 9.

* * * * *